US005577433A

United States Patent [19]

Henry

[11] Patent Number: 5,577,433

[45] Date of Patent: Nov. 26, 1996

[54] REGULATED SPEED LINEAR ACTUATOR

[76] Inventor: Michael F. Henry, 4504 W. Princeton, Broken Arrow, Okla. 74012

[21] Appl. No.: 523,874

[22] Filed: Sep. 6, 1995

[51] Int. Cl.[6] ..... F01B 13/00; F01B 9/00

[52] U.S. Cl. ..... 91/61; 91/451; 92/136

[58] Field of Search ..... 91/61, 6, 450, 91/451, 452; 92/136

[56] References Cited

U.S. PATENT DOCUMENTS

| | | | |
|---|---|---|---|
| 2,660,029 | 11/1953 | Geyer | 60/6 |
| 2,688,232 | 9/1954 | Geyer | 60/97 |
| 2,688,951 | 9/1954 | Sears | 121/38 |
| 2,859,640 | 11/1958 | Geyer | 74/625 |
| 2,875,980 | 3/1959 | Grace | 254/86 |
| 2,918,786 | 12/1959 | Geyer | 60/6 |
| 3,026,850 | 3/1962 | Clifton et al. | 91/61 X |
| 3,203,183 | 8/1965 | Lucien | 91/451 X |
| 3,449,971 | 6/1969 | Posh | 74/89.15 |
| 3,975,992 | 8/1976 | Cagle | 91/451 X |
| 4,050,319 | 9/1977 | Stanley | 74/89.15 |
| 4,123,965 | 11/1978 | Brown et al. | 92/136 |
| 4,295,384 | 10/1981 | Brandt et al. | 74/424.8 |
| 4,300,641 | 11/1981 | Kinkel | 92/136 X |
| 4,614,128 | 9/1986 | Fickler | 74/424.8 B |
| 4,867,000 | 9/1989 | Lentz | 74/89.15 |
| 5,099,749 | 3/1992 | Darish | 91/61 X |

*Primary Examiner*—Hoang Nguyen
*Attorney, Agent, or Firm*—Frank J. Catalano; Scott R. Zingerman

[57] ABSTRACT

In a linear actuator, a cylinder is separated into forward and reverse chambers by a piston. A lead screw is threadedly engaged in the piston and a piston rod connects to the load. A turbine applies torque to the screw to urge the screw toward clockwise or counterclockwise rotation depending on the direction of the piston movement. The tangent of the lead screw helix angle is so substantially equal to the coefficient of friction between the piston and the screw that the torque generated by the turbine does not significantly vary the force exerted on the load and the force on the load does not significantly vary the speed of movement of the load. Variations between the static and dynamic coefficients of friction between the lead screw and the piston can be offset by selection of an appropriate lead angle and friction coefficient in the turbine driven system. Variable relief pressure control valves selectively limit the net force applied to the piston according to the magnitude of the external load so that the actuator can be tuned for high efficiency and long life. Valves communicating with flow inlets to the turbine permit varying the speed of the flow of fluid into the turbine so that the extension and retraction speeds of the actuator will be established and remain constant within the power capability of the actuator.

21 Claims, 1 Drawing Sheet

REGULATED SPEED LINEAR ACTUATOR

BACKGROUND OF THE INVENTION

This invention relates generally to linear actuators and more particularly concerns linear actuator which provides regulated speed displacement regardless of the magnitude of the load.

Many presently known linear actuators employ dual drive systems. Typically, a pneumatic or hydraulic system is combined with a screw system which may be pneumatically, hydraulically or electrically driven. In some applications, both drive systems are used as load actuators with one system backing up the other in case of failure. In other applications, the systems simultaneously actuate the load. Either way, both drive systems affect the force applied to the load but none utilize these drive systems for the sole purpose of regulating the output speed of the actuator.

The efficiency and life of these actuators is further limited because the operating force overly exceeds the magnitude of the load and the difference is absorbed by the actuator components. Some dual systems counterbalance forces to hold this differential at a minimum, but then speed control suffers.

It is, therefore, an object of this invention to provide a dual drive linear actuator in which one drive system determines the force delivered to the load and the other drive system determines the speed of the load without varying the force delivered to the load. It is a further object of this invention to provide a dual drive linear actuator in which force is applied to the load by a pneumatic or hydraulic drive system while the speed of the load is independently controlled by a screw in a hydraulic, pneumatic, electric or clock driven system. Another object of this invention is to provide a dual drive linear actuator in which the extension and retraction speeds of the load do not vary as a consequence of the magnitude of the load. It is also an object of this invention to provide a dual drive linear actuator which is capable of holding the load in midstroke. And it is an object of this invention to provide a dual drive linear actuator in which the speed control system experiences no significant torque, even with a load of greatest magnitude.

SUMMARY OF THE INVENTION

In accordance with the invention, in a linear actuator for moving a load, a cylinder is separated into forward and reverse chambers by a piston. A lead screw is journalled at the forward chamber end of the housing and extends into the housing for rotation about its longitudinal axis. The lead screw is threadedly engaged in the piston. The rod which reciprocates with the piston extends through the reverse chamber end of the housing for connection to the load. A discrete passage into the reverse chamber permits filling and exhausting of the reverse chamber with and of fluid under pressure to selectively provide force to drive the piston in a reverse direction. Another discrete passage into the forward chamber permits filling and exhausting of the forward chamber with and of fluid under pressure to selectively provide force to drive the piston in a forward direction. A turbine applies torque to a worm in clockwise and counterclockwise directions depending on whether flow of fluid into the turbine is in a forward or reverse direction and a worm wheel transfers the torque from the worm to the screw. A set of magnets interacts with a disc supporting the vanes of the turbine to provide a magnetic dampening effect which is the only significant factor limiting the speed of the turbine other than the fluid entering the turbine.

The tangent of the helix angle of the lead screw is selected to be so substantially equal to the static coefficient of friction between the piston and lead screw that an insignificant torque, in theory approximately zero, will be required to initiate rotation of the lead screw consistent with the travel direction the piston is urged to by the pressure within the actuator. For most material combinations the dynamic coefficient of friction will be significantly less than the static friction coefficient. Therefore, when rotation begins, the piston will cause the lead screw to produce torque. To compensate for this torque, the tangent of the lead angle of the worm is selected to be substantially equal to the dynamic coefficient of friction between the worm and worm wheel. Thus, the turbine will sense an insignificant torque whether the actuator is at rest or in motion within the intended speed range of the actuator. This torque will be insignificant regardless of the engagement force between the piston and lead screw. External load fluctuations less than the net internal urging force exerted on the piston do not significantly vary the speed of the piston nor will these fluctuations be reflected as a torque sensed by the turbine. The torque produced by the turbine does not significantly add to or vary the force exerted on the piston and the load.

For some lead screw and piston material combinations, there will be little or no difference between the static and dynamic coefficients of friction. In this case, no compensation will be required of the worm and worm wheel. For still other lead screw and piston material combinations, the dynamic friction coefficient will be greater than the static friction coefficient. In this case, the tangent of the helix angle of the lead screw will be selected to equal the dynamic coefficient friction between the lead screw and piston and the tangent of the lead angle of the worm will be selected to equal the static coefficient of friction between the worm and worm wheel.

While it is generally assumed that the dynamic friction coefficient will be less than the static friction coefficient between the worm and the worm wheel, it is not necessarily the case. Still, a lead screw helix angle tangent and a worm lead angle tangent can be selected which will be appropriate for any combination of friction coefficients so that substantially zero torque will be presented to the turbine.

In practice, it is impossible to make helix angle or lead angle tangents exactly equal to the friction coefficients and therefore it is impossible to present exactly zero torque to the turbine under all circumstances. Nevertheless, the following design criteria will provide an actuator commensurate with the spirit and intent of the invention.

First, the value of the tangent of the helix angle of the lead screw should not be less than 70% or more than 130% of the value of the selected friction coefficient, whether static or dynamic.

Second, the value of the tangent of the lead angle of the worm should not be less than 70% or more than 130% of the value of the selected friction coefficient, whether static or dynamic.

Third, the lead screw should have a modified square thread with an included thread angle not exceeding 10 degrees.

A first valve communicating with the reverse chamber discrete passage has a variable relief pressure control for selectively limiting the net force applied to the piston and a second valve communicating with the forward chamber discrete passage also has a variable relief pressure control for selectively limiting the net force applied to the piston. A third valve communicating with a forward flow inlet to the turbine permits varying the mass flow rate of fluid into the turbine in the forward direction and a fourth valve communicating with a reverse flow inlet to the turbine permits varying the mass flow rate of fluid into the turbine in the reverse direction. Preferably, all the valves are connected to a common source of fluid under pressure.

By setting the relief valves to closely coordinate the net force on the piston to the magnitude of the external load, the actuator can be tuned for high efficiency and long life. By setting the turbine flow control valves the extension and retraction speeds of the actuator will be established and remain constant within the power capability of the actuator.

BRIEF DESCRIPTION OF THE DRAWINGS

Other objects and advantages of the invention will become apparent upon reading the following detailed description and upon reference to the drawings in which.

Figure 1:
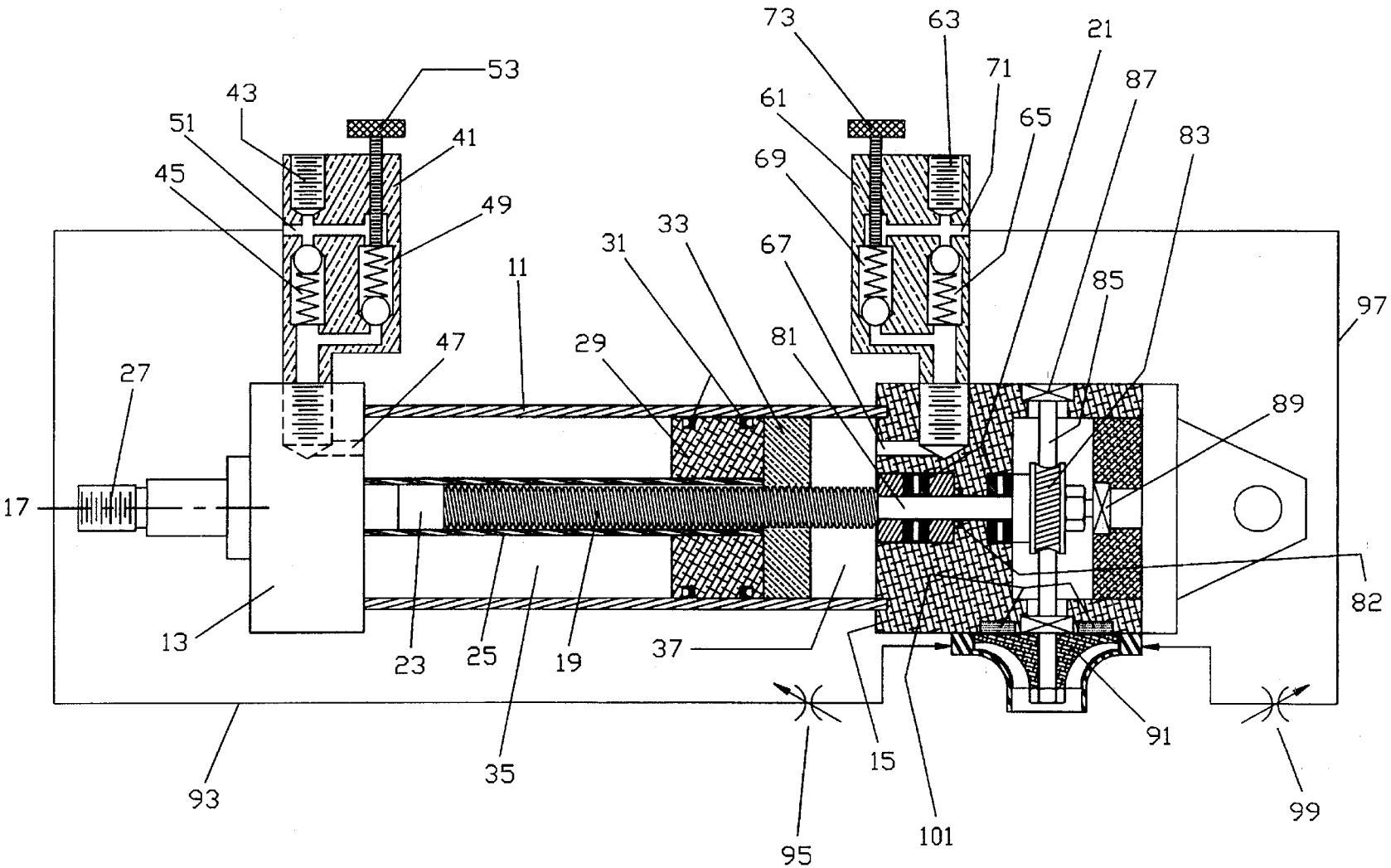
FIG. 1 is a cross-sectional view taken along a plane extending through the longitudinal axis of a preferred embodiment of the dual drive regulated speed linear actuator.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Looking at the Figure, the dual drive regulated speed linear actuator includes a cylinder 11 extending between a load end housing 13 and a control housing 15 along a longitudinal axis 17. A lead screw 19 extending in the cylinder 11 along the longitudinal axis 17 is connected at one end to roller thrust bearings 21 mounted in the control housing 15 and at the other end to a bronze slider 23 which is mounted on ball bearings proximate the load end housing 13. A piston rod 25 concentrically disposed about the lead screw 19 extends through the load end housing 13 to a load connector 27 on one end and on the other end to a piston 29 slidably disposed in the cylinder 11 on cup seals 31. A drive nut 33 threadedly engaged on the lead screw 19 is fixed to the face of the piston 29 closest to the control housing 15. The piston 29 and drive nut 33 divide the cylinder 11 into a reverse chamber 35 and a forward chamber 37.

To drive the piston 29, the load end housing 13 has a reverse chamber valve housing 41 threadedly engaged with a primary valve passage 43 connected through a check valve 45 to a reverse chamber inlet 47. A relief valve 49 is connected in parallel with the check valve 45 and the inlet side of this parallel arrangement communicates through an outlet 51 extending out of the reverse chamber valve housing 41. The relief valve 49 is provided with a control knob 53 threadedly engaged in the housing 41.

A forward chamber valve housing 61 with a primary valve passage 63 is threadedly engaged in the control housing 15. The primary valve passage 63 includes a check valve 65 which is connected on its other side to the forward chamber inlet 67. A relief valve 69 is connected in parallel with the check valve 65 and the input side of this parallel arrangement is connected to an outlet 71 from the forward chamber valve housing 61. A control knob 73 threadedly engaged in the forward chamber valve housing 61 controls the pressure at which the relief valve 69 responds.

In the operation of the load drive system of the actuator, the relief valves 49 and 69 are used to establish the most efficient operating forces in the load drive system. For example, assume a load of fifty pounds is to be driven in the forward direction by the system, and on the return that the load will be substantially zero pounds. In this case, the control knob 53 in the reverse chamber valve housing 41 is adjusted to establish an operating pressure in the relief valve 49 which is barely sufficient to overcome the fifty pound load. Then, for example, if we assume a 100 psi operating pressure is applied to the primary valve passages 63, if the relief valve 49 operates at 20 psi, a resulting 80 psi differential may produce a 55 pound force, fifty pounds of which will be absorbed by the load and five pounds of which will be absorbed between the drive nut 33 and the lead screw 19. By appropriate adjustment of the control knob 53, the loss can be minimized. Similarly, on the return of the piston, if the relief valve 69 in the forward chamber valve housing 61 is set for 95 psi in the forward chamber 37, then the differential on return is reduced to 5 psi. The lighter the load is balanced, the more efficient the operation will be.

Now considering the control drive system of the actuator, a coupler shaft 81 extending from the lead screw 19 through the roller thrust bearings 21 connects to a worm wheel 83 which is in turn driven by a transverse worm 85 journalled to the control housing 15 by ball bearings 87. As shown, the coupler shaft 81 extends through the cup seal 82 and worm wheel 83 to another ball bearing 89 in the control housing 15. The worm 85 is driven by a turbine 91. The turbine 91 is in turn driven in one rotational direction by the introduction of fluid under pressure through a line 93 connected to a reverse speed control valve 95 to the outlet 51 in the primary valve passage 43 of the reverse chamber valve housing 41. The turbine 91 is driven in the opposite direction by fluid under pressure being fed from the outlet 71 of the primary valve passage 63 in the forward chamber valve housing 61 via a line 97 through a forward speed control valve 99. The turbine speed is controlled by the fluid pressure applied to the turbine vanes and by the induced force of magnets 101.

In the operation of the speed control drive system, the coefficient of friction between the drive nut 33 and the lead screw 19 is so substantially equal to the tangent of the helix angle of the lead screw 19 as to substantially isolate the load drive system from the control drive system. That is, force exerted on the piston 29 and the load does not significantly vary the piston or turbine speed and the torque exerted by the turbine 91 does not significantly vary the force exerted on the piston 29 and the load. If the static coefficient of friction between the lead screw 19 and the drive nut 33 is significantly greater than the dynamic coefficient of friction, then the dynamic coefficient of friction between the worm 85 and the worm wheel 83 is selected in relation to the tangent of the lead angle of the worm 85 as to counterbalance the system.

The tangent of the helix angle of the lead screw 19 is selected to be so substantially equal to the static coefficient of friction between the drive nut 33 and lead screw 19 that an insignificant torque, in theory approximately zero, will be required to initiate rotation of the lead screw 19 consistent with the travel direction the piston 29 is urged to by the pressure within the actuator. For most material combinations the dynamic coefficient of friction will be significantly less than the static friction coefficient. Therefore, when rotation begins, the piston 29 will cause the lead screw 19 to produce torque. To compensate for this torque, the tangent of the lead angle of the worm 85 is selected to be substantially equal to the dynamic coefficient of friction between the worm 85 and worm wheel 83. Thus the turbine 91 will sense an insignificant torque whether the actuator is at rest or in motion within the intended speed range of the actuator. This torque will be insignificant regardless of the engagement force between the drive nut 33 and lead screw 19. External load fluctuations less than the net internal urging force exerted on the piston 29 do not significantly vary the speed of the piston 29 nor will these fluctuations be reflected as a torque sensed by the turbine 91. The torque produced by the turbine 91 does not significantly add to or vary the force exerted on the piston 29 and the load.

For some lead screw and piston material combinations, there will be little or no difference between the static and dynamic coefficients of friction. In this case, no compensation will be required of the worm 85 and worm wheel 83. For still other lead screw and piston material combinations, the dynamic friction coefficient will be greater than the static friction coefficient. In this case, the tangent of the helix angle of the lead screw 19 will be selected to equal the dynamic coefficient friction between the lead screw 19 and drive nut 33 and the tangent of the lead angle of the worm 85 will be selected to equal the static coefficient of friction between the worm 85 and the worm wheel 83.

While it is generally assumed that the dynamic friction coefficient will be less than the static friction coefficient between the worm 85 and the worm wheel 83, a lead screw helix angle tangent and a worm lead angle tangent can be selected which will be appropriate for any combination of friction coefficients so that substantially zero torque will be presented to the turbine 91.

In practice, it is impossible to make helix angle or lead angle tangents exactly equal to the friction coefficients and therefore it is impossible to present exactly zero torque to the turbine 91 under all circumstances. Nevertheless, the following design criteria will provide an actuator commensurate with the spirit and intent of the invention.

First, the value of the tangent of the helix angle of the lead screw 19 should not be less than 70% or more than 130% of the value of the selected friction coefficient, whether static or dynamic.

Secondly, the value of the tangent of the lead angle of the worm 85 should not be less than 70% or more than 130% of the value of the selected friction coefficient, whether static or dynamic.

Third, the lead screw should have a modified square thread with an included thread angle not exceeding 10 degrees.

The forward and reverse speed control valves 95 and 99 are set to limit the force exerted on the turbine 91 in relation to the braking action of the magnets 101 so that the power delivered by the turbine 91 through the worm wheel 83 is too insignificant to drive the drive nut 33 alone, much less the load in combination with it. Thus, when fluid pressure is applied to the piston 29 in the forward chamber 37, the lead screw 19 would be in a locked condition except that the pressure applied to the turbine 91 permits the lead screw 19 to rotate.

Preferably, a steel lead screw having a steep 7/16-12 double lead square thread screw will be used with a bronze drive nut for a two inch bore actuator of moderate stroke. This lead will be appropriate for the anticipated static friction coefficient. Since a steel lead screw and bronze drive nut combination will have a dynamic friction coefficient significantly less than the static coefficient, a compensating selection will be required in the worm and worm wheel combination for the intended speed range of the actuator. Also preferably, the tangent of the helix angle of the lead screw 19 will be slightly greater than the coefficient of friction between the lead screw 19 and the drive nut 33 so as to allow for imperfections in the system.

The fluid pressure system can be pneumatic or hydraulic and the turbine could be replaced by a constant or variable speed electric motor, servo motor, stepper motor, mechanical clock, hand crank or other motivating device. The piston 29 and drive nut 33 could be replaced by a single component.

Thus, it is apparent that there has been provided, in accordance with the invention, a regulated speed linear actuator that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A linear actuator for moving a load comprising:

a housing;

a piston separating said housing into forward and reverse chambers;

a lead screw journalled at a forward chamber end of and extending into said housing for rotation about a longitudinal axis thereof and threadedly engaged in said piston;

means fixed to said piston for reciprocal motion therewith and extending through said housing for connection to the load;

means communicating through discrete passages for filling and exhausting said chambers with and of fluid under pressure to selectively provide force to drive said piston and the load in forward and reverse directions; and means engaged to said lead screw for selectively providing torque to urge said lead screw toward clockwise and counterclockwise rotation thereof in response to said force driving said piston in forward and reverse directions, respectively;

said lead screw having a helix angle tangent so substantially equal to a coefficient of friction between said piston and said lead screw that said torque does not significantly vary said force and said force does not significantly vary the speed of movement of the load.

2. A linear actuator according to claim 1, said communicating means further comprising valve means communicating with a one of said discrete passages which communicates with said reverse chamber, said valve means having a variable relief pressure control for selectively limiting a net force applied to said piston.

3. A linear actuator according to claim 1, said communicating means further comprising valve means communicating with a one of said discrete passages which communicates with said forward chamber, said valve means having a variable relief pressure control for selectively limiting a net force applied to said piston.

4. A linear actuator according to claim 1, said communicating means further comprising first valve means communicating with a one of said discrete passages which communicates with said reverse chamber, said first valve means having a variable relief pressure control for selectively limiting a net force applied to said piston and a second valve means communicating with another of said discrete passages which communicates with said forward chamber, said second valve means having a variable relief pressure control for selectively limiting said net force applied to said piston.

5. A linear actuator according to claim 1, said torque providing means comprising:

a shaft;

means coupling said shaft to said screw for transferring torque applied to said shaft to said screw; and a turbine applying torque to said shaft in clockwise and counterclockwise directions in response to a flow of fluid into said turbine in forward and reverse directions, respectively.

6. A linear actuator according to claim 5 further comprising means connected between a source of fluid and a forward flow inlet to said turbine for selectively varying a flow rate of fluid into said turbine in said forward direction.

7. A linear actuator according to claim 5 further comprising means connected between a source of fluid and a reverse flow inlet to said turbine for selectively varying a flow rate of fluid into said turbine in said reverse direction.

8. A linear actuator according to claim 5 further comprising means connected between a source of fluid and a forward flow inlet to said turbine for selectively varying a flow rate of fluid into said turbine in said forward direction and means connected between a source of fluid and a reverse flow inlet to said turbine for selectively varying a flow rate of fluid into said turbine in said reverse direction.

9. A linear actuator according to claim 5 further comprising means for dampening rotation of said turbine.

10. A linear actuator according to claim 9, said dampening means comprising a plurality of magnets interacting with a vane disc of said turbine.

11. A linear actuator according to claim 5, said coupling means comprising a worm and worm wheel, said worm having a worm lead angle tangent substantially equal to a coefficient of friction between said worm and said worm wheel.

12. A linear actuator for moving a load comprising:

a cylindrical housing;

a piston separating said housing into forward and reverse chambers;

a lead screw journalled at a forward chamber end of and extending into said housing for rotation about a longitudinal axis thereof and threadedly engaged in said piston;

a rod fixed to said piston for reciprocal motion therewith and extending through a reverse chamber end of said housing for connection to the load;

a discrete passage into said reverse chamber for filling and exhausting said reverse chamber with and of fluid under pressure to selectively provide force to drive said piston in a reverse direction;

a discrete passage into said forward chamber for filling and exhausting said forward chamber with and of fluid under pressure to selectively provide force to drive said piston in a forward direction;

a worm;

a turbine applying torque to said worm in clockwise and counterclockwise directions in response to a flow of fluid into said turbine in forward and reverse directions, respectively;

a worm wheel coupling said shaft to said screw for transferring said torque applied to said worm to said screw; and a plurality of magnets interacting with a vane disc of said turbine for limiting said torque to a magnitude sufficient to urge said lead screw toward clockwise and counterclockwise rotation thereof in response to said force driving said piston in forward and reverse directions, respectively;

said piston and said lead screw having a static coefficient of friction therebetween so substantially equal to a tangent of a helix angle of said lead screw that said torque does not significantly vary said force and said force does not significantly vary the speed of movement of the load.

13. A linear actuator according to claim 12, said worm having a lead angle tangent selected in relation to a dynamic coefficient of friction between said worm and said worm wheel as to counterbalance any significant variations between dynamic and said static coefficients of friction between said piston and said lead screw.

14. A linear actuator according to claim 12 further comprising a first valve communicating with said reverse chamber discrete passage, said first valve having a variable relief pressure control for selectively limiting a net force applied to said piston, and a second valve communicating with said forward chamber discrete passage, said second valve having a variable relief pressure control for selectively limiting said net force applied to said piston.

15. A linear actuator according to claim 14 further comprising a third valve communicating with a forward flow inlet to said turbine for selectively varying a flow rate of fluid into said turbine in said forward direction and fourth valve communicating with a reverse flow inlet to said turbine for selectively varying a flow rate of fluid into said turbine in said reverse direction.

16. A linear actuator according to claim 15, said first, second, third and fourth valves being connected to a common source of fluid under pressure.

17. A linear actuator for moving a load comprising:

a cylindrical housing;

a piston separating said housing into forward and reverse chambers;

a lead screw journalled at a forward chamber end of and extending into said housing for rotation about a longitudinal axis thereof and threadedly engaged in said piston;

a rod fixed to said piston for reciprocal motion therewith and extending through a reverse chamber end of said housing for connection to the load;

a discrete passage into said reverse chamber for filling and exhausting said reverse chamber with and of fluid under pressure to selectively provide force to drive said piston in a reverse direction;

a discrete passage into said forward chamber for filling and exhausting said forward chamber with and of fluid under pressure to selectively provide force to drive said piston in a forward direction;

a worm;

a turbine applying torque to said worm in clockwise and counterclockwise directions in response to a flow of fluid into said turbine in forward and reverse directions, respectively;

a worm wheel coupling said shaft to said screw for transferring said torque applied to said worm to said screw; and a plurality of magnets interacting with a vane disc of said turbine for limiting said torque to a magnitude sufficient to urge said lead screw toward clockwise and counterclockwise rotation thereof in response to said force driving said piston in forward and reverse directions, respectively;

said piston and said lead screw having a dynamic coefficient of friction therebetween so substantially equal to a tangent of a helix angle of said lead screw that said torque does not significantly vary said force and said force does not significantly vary the speed of movement of the load.

18. A linear actuator according to claim 17, said worm having a lead angle tangent selected in relation to a static coefficient of friction between said worm and said worm wheel as to counterbalance any significant variations between dynamic and said static coefficients of friction between said piston and said lead screw.

19. A linear actuator according to claim 17 further comprising a first valve communicating with said reverse chamber discrete passage, said first valve having a variable relief pressure control for selectively limiting a net force applied to said piston, and a second valve communicating with said forward chamber discrete passage, said second valve having a variable relief pressure control for selectively limiting said net force applied to said piston.

20. A linear actuator according to claim 19 further comprising a third valve communicating with a forward flow inlet to said turbine for selectively varying a flow rate of fluid into said turbine in said forward direction and fourth valve communicating with a reverse flow inlet to said turbine for selectively varying a flow rate of fluid into said turbine in said reverse direction.

21. A linear actuator according to claim 20, said first, second, third and fourth valves being connected to a common source of fluid under pressure.

* * * * *